US005776299A

United States Patent [19]

Morris

[11] Patent Number: 5,776,299

[45] Date of Patent: Jul. 7, 1998

[54] LOW PROFILE ROOFING TORCH

[76] Inventor: Paul L. Morris, 8815 W. 104th St., Overland Park, Kans. 66212

[21] Appl. No.: 635,621

[22] Filed: Apr. 22, 1996

[51] Int. Cl.[6] ..... B32B 31/00

[52] U.S. Cl. ..... 156/497; 156/499; 156/579

[58] Field of Search ..... 156/497, 499, 156/574, 577, 579, 82, 71

[56] References Cited

U.S. PATENT DOCUMENTS

| | | | |
|---|---|---|---|
| 736,149 | 8/1903 | Phipps | 126/404 |
| 776,950 | 12/1904 | Simpson | 156/577 X |
| 907,731 | 12/1908 | Buckborough | 156/577 X |
| 1,773,153 | 8/1930 | Remnsnider | 242/578 |
| 2,084,625 | 6/1937 | Stebbins et al. | 156/497 X |
| 2,692,641 | 10/1954 | Woods | 126/401 |
| 3,079,980 | 3/1963 | Mihm | 126/401 |
| 3,099,582 | 7/1963 | Ongstad et al. | 156/579 X |
| 4,239,581 | 12/1980 | Lang | 126/271.2 |
| 4,259,142 | 3/1981 | Kosteperter | 156/579 X |
| 4,460,433 | 7/1984 | Boyd | 156/574 |
| 4,658,802 | 4/1987 | Schultz | 126/271.2 |
| 4,725,328 | 2/1988 | Arnold | 156/497 X |
| 4,761,201 | 8/1988 | Nichols, Jr. | 156/497 |
| 4,869,044 | 9/1989 | Wald | 156/577 X |
| 4,918,844 | 4/1990 | Marsh | 126/271.2 R X |
| 5,211,158 | 5/1993 | Morris | 156/497 X |
| 5,353,782 | 10/1994 | Morris | 156/497 X |
| 5,439,540 | 8/1995 | Lipman et al. | 156/579 X |

FOREIGN PATENT DOCUMENTS

| | | | |
|---|---|---|---|
| 8912724 | 12/1989 | WIPO | 156/577 |

*Primary Examiner*—James Engel

*Attorney, Agent, or Firm*—Hovey,Williams, Timmons & Collins

[57] ABSTRACT

An improved torch assembly (10) designed for use in the formation of roof lap joints even in cold weather is provided which includes an elongated handle (12) having a low profile torch head assembly (17) secured thereto. The assembly (17) has a drag shoe (14) adapted to receive a torch head (16) and direct combustion products through a rearward outlet opening (54). Minimal torch head assembly height is provided so as to avoid cracking of stiff lap weld material during cold weather use, and is achieved through use of an elongated, rectangular in cross-section torch head (16) which fits between upper and lower walls (24, 32) forming a part of shoe (14); the head (16) has a number of large area air inlets (74) owing to its rectangular configuration, allowing generation of sufficient heat to give lap welds of high integrity. In an alternative configuration, a carriage assembly (76) is coupled with the torch head assembly (17) for supporting a roll (77) of roofing material above the torch head (16).

7 Claims, 3 Drawing Sheets

10
30
32
14
42
52
55
36
28
12
34
16
66
62
72
46
18
20
40
22
70
74
68
60
58
56
48
50

20
10
17
18
40
34
42
50
55
12
60
62
68
58
56
36
54
28
38
22
16
26
64
24
14
48
44

34
20
10
42
55
50
40
18
46
32
12
54
28
44
52
14
26
30

18
12
10
40
20
34
14
42
55
60
58
50
54
16
56
44
48
72
26

12
18
40
42
10
55
50
58
30
32
52
14
28
26
16

LOW PROFILE ROOFING TORCH

BACKGROUND OF THE INVENTION

1. Field of the Invention

The present invention is broadly concerned with an improved low-profile torch assembly of the type particularly useful in roofing applications where roofing membranes must be heated for the formation of lap joints between sections of roofing material. More particularly, it is concerned with such a torch assembly including an elongated handle having a drag shoe element coupled to the lower end thereof and receiving a strategically oriented and configured torch head; the torch head is in the form of an elongated, generally rectangular in cross-section body having a rearward flame-exiting end, so that the entire torch head assembly made up of the shoe element and torch has the smallest possible vertical height. In this way, lap welding operations may be successfully carried out even in cold weather when the lap material is relatively stiff and susceptible to cracking when prior torch assemblies are used.

2. Description of the Prior Art

Many commercial roof constructions include a metal substrate having a foam insulating layer thereon, with a rigid, weather-resistant roofing board applied over the foam layer. Finally, modified bitumen roofing membrane is secured to the roofing board, typically through the use of an asphalt-based roofing mastic. Installation of such a built-up roof involves first attaching prefabricated panels each made up of preformed foam and roofing board layers over the metal deck, followed by application of roofing mastic and finally the roofing membrane. The latter material is generally provided in rolls, and successive, overlapped strips thereof are applied to the prefabricated panels and adhered in placed by the roofing mastic. The lap joints between adjacent membrane strips are also adhesively secured by heating the lap joint regions, and the membranes are rolled to complete the roof.

During formation of the lap joints, it is common to employ a trowel or other implement in one hand to lift a lap section, and hand-held torch in the other hand for the purpose of heating the membrane in and around the lap area. Thereafter, the upper layer of the lap joint is laid over the heated membrane and the joint is rolled. Use of a conventional roof torch has proven to be somewhat troublesome and difficult. Specifically, elevating the lap section and playing a torch flame over roofing membranes inevitably leads to uneven heating and consequent poor lap joint welding. Hence, the lack of suitable means for orienting the torch and maintaining its position as a lap joint is traversed is a major problem, and this increases the time spent in properly forming a lap joint. Moreover, the finished joints may be deficient and subject to failure due to wind lifting.

U.S. Pat. No. 5,211,158 (incorporated by reference herein) represents a decided advance in the art and describes a roofing torch assembly having an elongated, tubular handle with a drag shoe adjacent the lower end thereof. The shoe houses an elongated, tubular, essentially circular in cross-section torch. In use, the torch assembly is pulled along a lap joint beneath the outer lap section while hot combustion products generated within the torch heat the roofing material sections. A roller or other device is then used to press the heated lap sections together to form a completed joint.

While devices of the type described in the '158 patent have proved highly useful and efficient in practice, a problem sometimes arises when lap welding operations are conducted during cold weather. Specifically, under these conditions, the lap roofing material tends to stiffen and is prone to cracking if bent or manipulated to a substantial degree. The overall height of the shoe element described in the '158 patent is sufficient to sometimes crack or split the upper lap section during such cold weather installations, with the result being a lap joint of diminished integrity.

In order to overcome this difficulty, attempts were made to employ tubular torch heads of smaller diameter, thereby permitting use of a reduced height shoe element and thus lowering the vertical profile of the overall torch head assembly. This simple expedient proved unworkable, however, because such smaller diameter tubular torch heads did not have sufficient area to allow enough inlet air openings. As a consequence, such experimental low profile torch head assemblies did not have enough BTU output to achieve the temperatures necessary for adequate lap welding.

There is accordingly a need in the art for an improved torch head assembly of low profile permitting cold weather usage without lap material cracking and which is capable of generating sufficiently high temperatures to give secure, permanent lap welds.

SUMMARY OF THE INVENTION

The problems outlined above are solved by the present invention which provides a low profile torch head assembly for use in fabricating roof joints or the like under all ambient temperature conditions wherein the torch head is properly oriented and configured in position to effectively heat the lap joint area of roofing membrane. To this end, the torch assembly of the invention includes an elongated handle presenting an upper and lower end, with a shoe element operably coupled to the lower end of the handle and having upper and lower wall sections cooperatively defining an elongated chamber with a rearward outlet opening. A torch head is located within the shoe chamber and is oriented for delivery of flame through the rearward open end of the shoe. Very importantly, the torch head is in the form of an elongated body of generally rectangular cross-section with a series of air inlets adjacent the forward end thereof and an open, flame-exiting rearward end. Advantageously, the torch head has generally parallel top and bottom walls and upright sidewalls, with the top and bottom walls being wider than the sidewalls and with the top and bottom walls generally parallel with the shoe element upper and lower walls. It has been found that use of such a rectangular in cross-section torch head allows significant reductions in the overall height of the shoe element (e.g., up to a maximum of about 4 inches, more preferably up to about 3 inches), while at the same time permitting sufficient air inlets to generate high lap welding temperatures.

It has been found that the low profile torch head assembly of the invention can be used in all weather conditions where roofing operations are otherwise possible, without fear of cracking of lap sections or the creation of inadequate lap welds.

In preferred forms, the handle is in the form of an elongated gas delivery tube operably coupled to the torch head, and a valve associated with the handle adjacent its upper end is selectively operable for controlling flow of fuel to the torch. Moreover, the upper and lower wall sections of the shoe are advantageously formed as an integral unit, with the lower wall section being adapted to be moved along a lap joint area. To this end, the lower wall has a substantially flat main panel section for sliding along a lap joint area, with a rearward upturned extension causing the shoe outlet opening to be located above the main panel section. On the other hand, the upper wall section is designed to slide beneath the lap portion of an adjacent membrane strip, and therefore is preferably flat.

DETAILED DESCRIPTION OF THE PREFERRED EMBODIMENT

Figure 3:
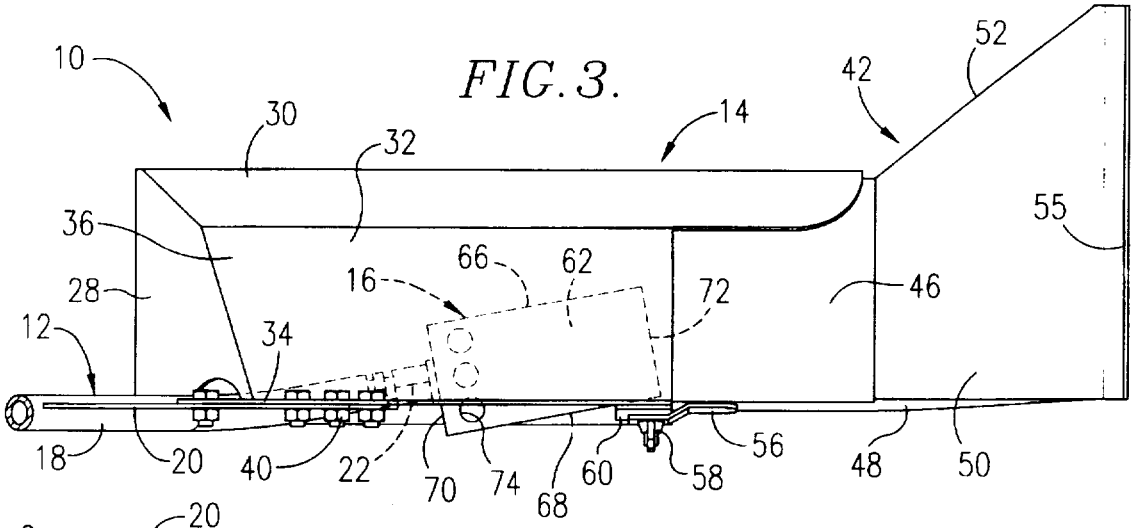
FIG. 3 is a plan view of the torch head assembly, with the torch head being shown partially in phantom.

Turning now to the drawings, a roofing torch assembly 10 is illustrated. Broadly speaking, the assembly 10 includes an elongated handle 12 having a shoe element 14 secured the lower end thereof. The shoe element in turn houses torch head 16 which is strategically oriented and configured for proper application of flame to a lap joint. The shoe element 14 and torch head 16 therein together define a torch head assembly 17 secured to handle 12.

In more detail, the handle 12 is in the form of an elongated, tubular metallic body 18 adapted to convey torch fuel therethrough. The body 18 has, adjacent its upper end and in operative communication with the interior thereof, a selectively operable fuel valve and an external grip; a gas tube is operably coupled with the fuel valve and is adapted for connection to a flexible gas line leading to a source of fuel gas. An auxiliary hand grip is also secured to body 18 adjacent its upper end.

The body 18, adjacent the lowermost end thereof where the tube is bent to a generally horizontal orientation, is equipped with an upstanding, integrally attached, apertured web 20. The terminal end of the body 18 moreover has a threaded fixture 22 thereon.

The shoe element 14 includes a lowermost wall 24 presenting a generally flat main panel 26 as well as upstanding, obliquely oriented side flanges 28 and 30. The element 14 also includes an integral top wall 32, the latter having an upstanding apertured bracket 34 adjacent web 20. The walls 24–32 cooperatively define an elongated, torch head-receiving chamber 36 having an open side 38. As illustrated, connectors 40 are used to connect web 20 and bracket 34, so that handle 12 is secured to shoe element 14.

Figure 4:
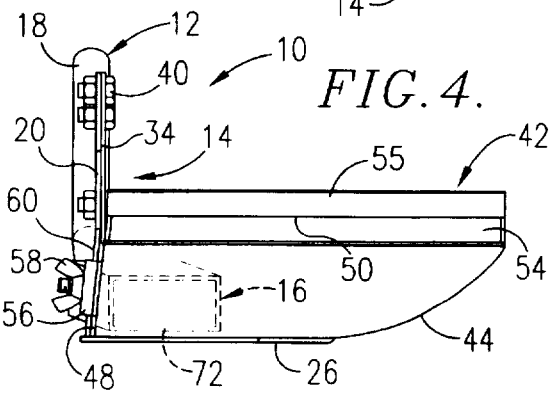
FIG. 4 is a rear view of the torch head assembly.
Figure 5:
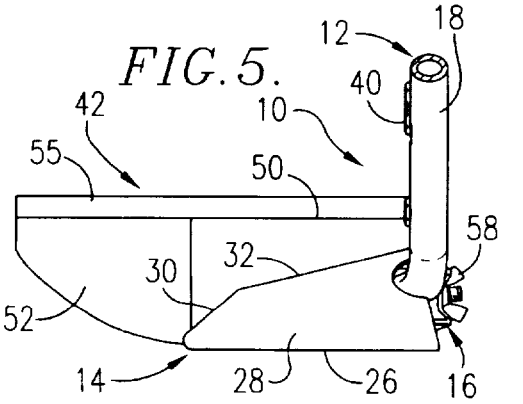
FIG. 5 is a front view of the torch assembly.
Figure 9:
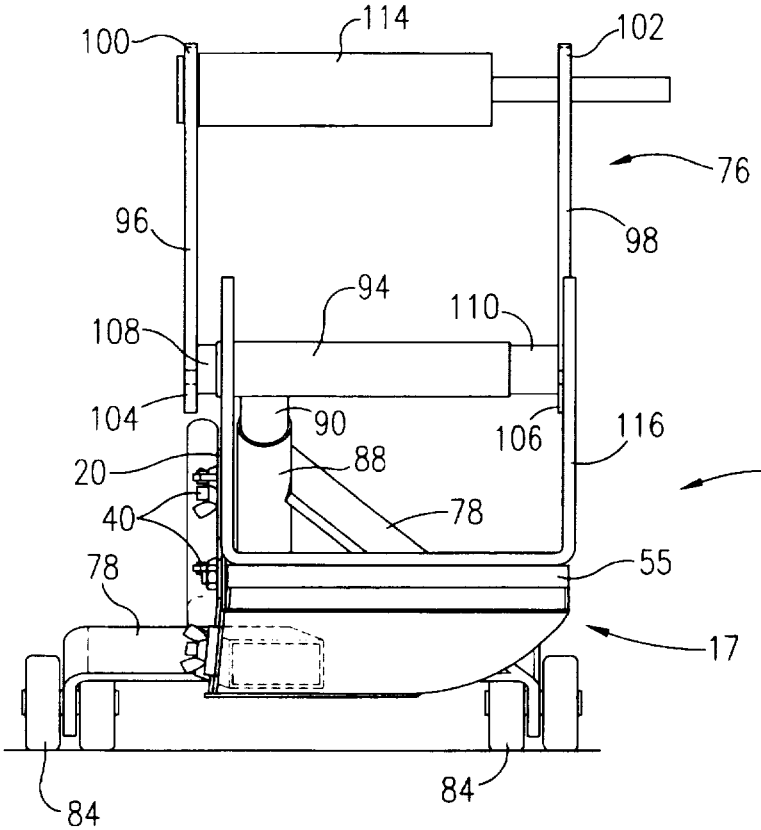
FIG. 9 is a rear view of the carriage and torch head assemblies.

The overall shoe element 14 further includes a rearward, hollow, flame-directing housing 42 which is telescoped within and extends rearwardly from walls 24, 32. The housing 42 includes an upturned lower wall 44 which in effect forms a continuation of the lower wall 24, with integral, top wall 46 and sidewall 48. The rearmost portion of the housing 42 is laterally flared and has top wall segment 50 and oblique sidewall 52. The walls 44, 50 and 52 cooperatively define a generally horizontal rearmost outlet opening 54 (see FIG. 4) which extends the full width of the housing 42. As illustrated, a continuation of wall 50 forms an upturned lip 55 directly above opening 54 in order to slidingly support a section of lap material (not shown) during use of torch assembly 10.

Figure 1:
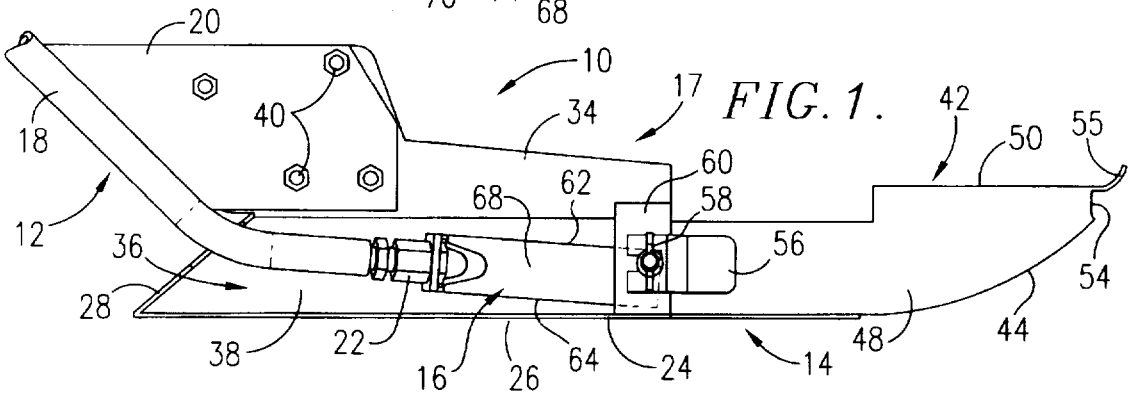
FIG. 1 is a side view of the torch head assembly of the invention, illustrating the configuration and orientation of the preferred rectangular torch head.
Figure 2:
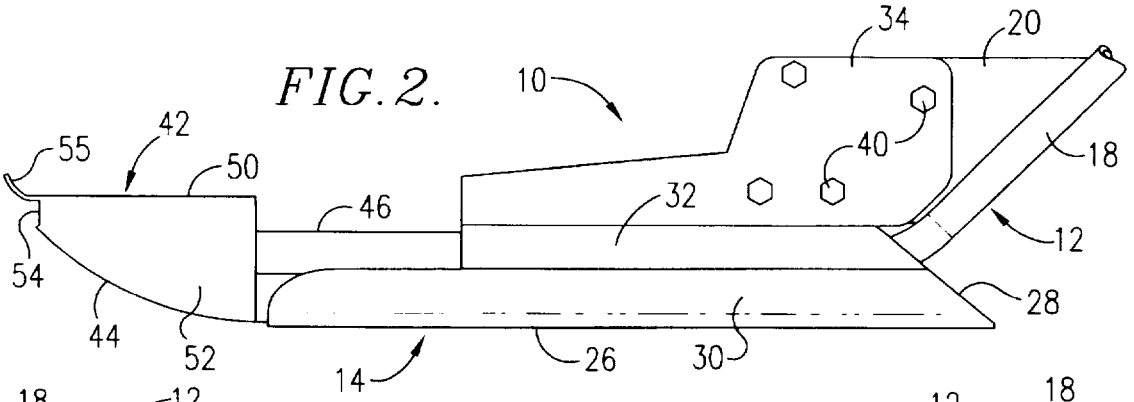
FIG. 2 is another side view of the torch head assembly, viewing from the side opposite that depicted in FIG. 1.

The housing 42 is secured to walls 24, 32 by means of a bifurcated bracket 56 secured to sidewall 48 and connected, via connector 58, to an upstanding, apertured wall member 60 extending between walls 24 and 32 (FIG. 1).

It will thus be seen that the walls 24, 32 and housing 42 cooperatively present the shoe element 14 which receives torch head 16 and directs products of combustion therefrom toward and out of opening 54 in order to effectively heat and weld lap-forming sections of roofing material.

The torch head 16 is specially configured so that the overall height of the torch head assembly 17 is at a minimum. As best seen in FIGS. 1 and 3, the head 16 is in the form of an elongated, rectangular in cross-section body made up of generally parallel top and bottom walls 62, 64, sidewalls 66, 68, and front wall 70, so as to define a rearmost, open, rectangular flame-directing end 72 (See FIG. 4). The head 16 also has a series of air inlet apertures 74 therethrough adjacent front wall 70, and is operatively coupled with handle 12 via fixture 22. It is to be noted that torch head walls 62, 64 are generally parallel with shoe walls 24, 32 so that the height of torch head assembly 17 is minimized.

During lap joint formation, the torch assembly 10 is placed atop a lap joint area, with an overlapping end section of roofing membrane resting atop shoe element 14, and particularly lip 55 and the upper defining walls of the shoe element. The torch head 16 is then fired, with fuel gas being delivered through the handle 12. As the torch is thus operated to create a flame of combustion products exiting head 16 and extending rearwardly through opening 54, the entire assembly 10 is pulled forwardly. This serves to uniformly heat the lap joint area, allowing the roofing membrane sections to be pressed together. Usually, a roller or other similar device (not shown) is employed to press the membranes together. This serves to complete the lap joint.

Given that the torch head assembly 17 is of minimum height, welding operations as described can be effectively carried out in all weather, without fear of cracking or splitting of the upper lap membrane. At the same time, the assembly 17 is capable of generating sufficient heat to create very effective lap joints.

Figure 6:
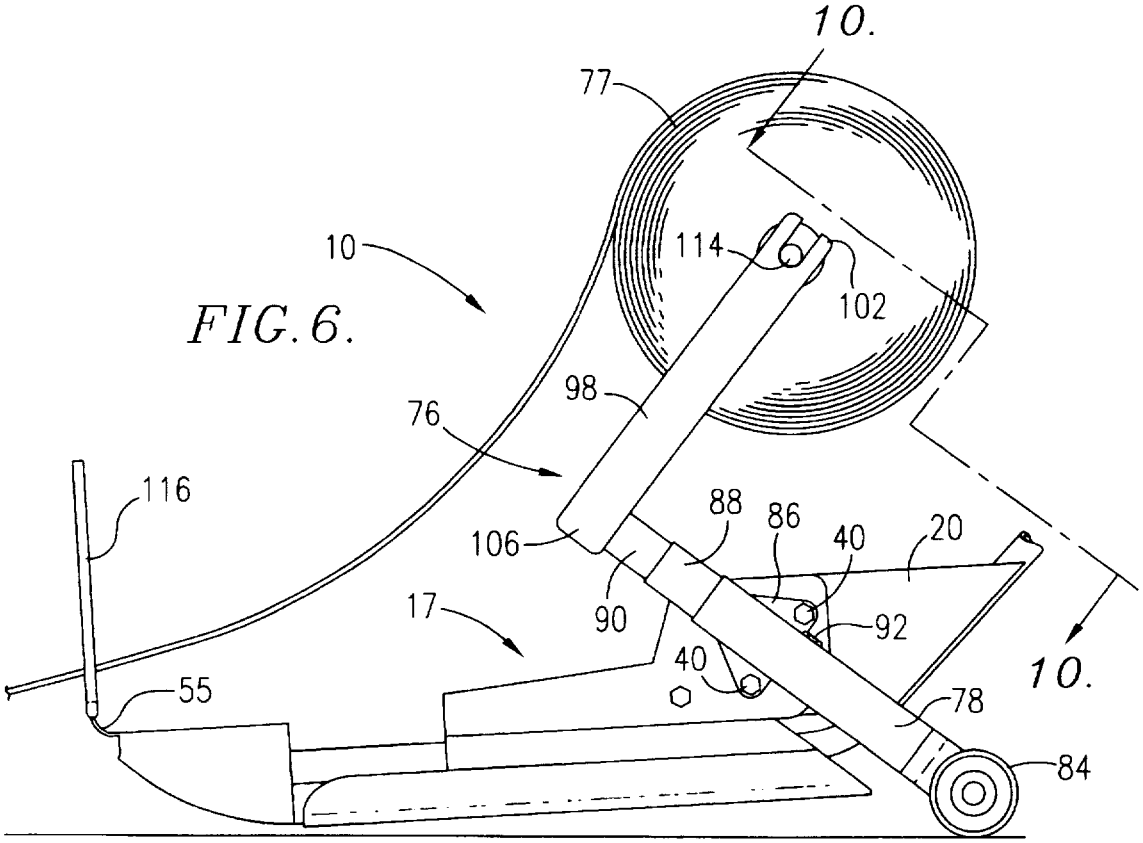
FIG. 6 is a side view of a carriage assembly coupled with a torch head assembly supporting a roll of roofing membrane.
Figure 8:
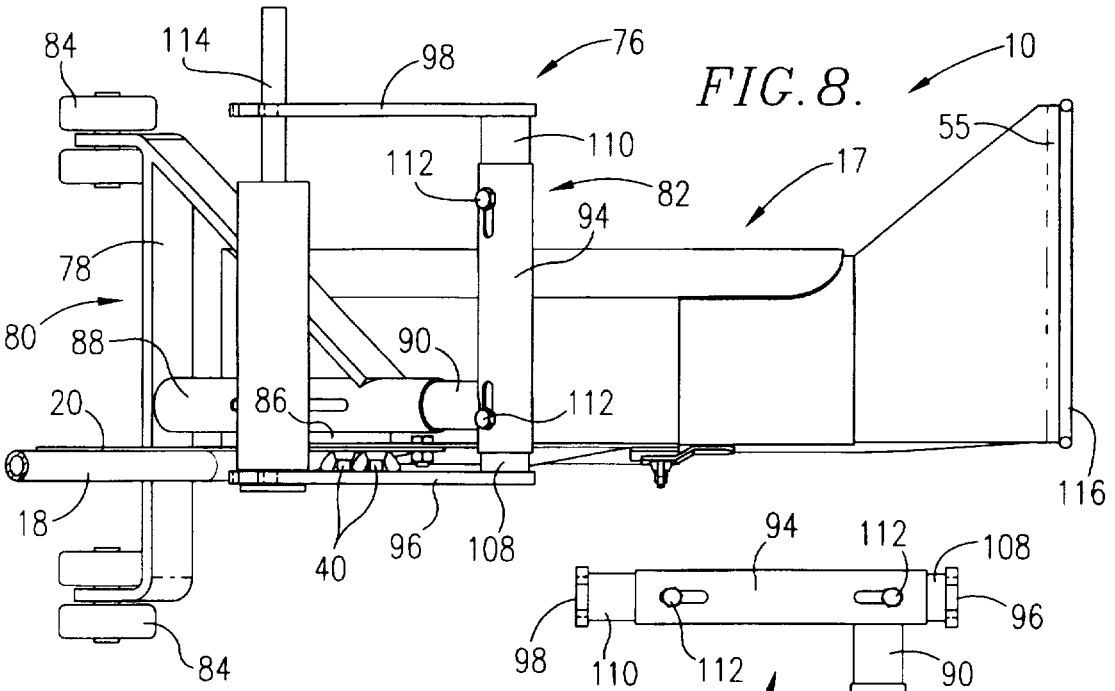
FIG. 8 is a plan view of the carriage and torch head assemblies.
Figure 10:
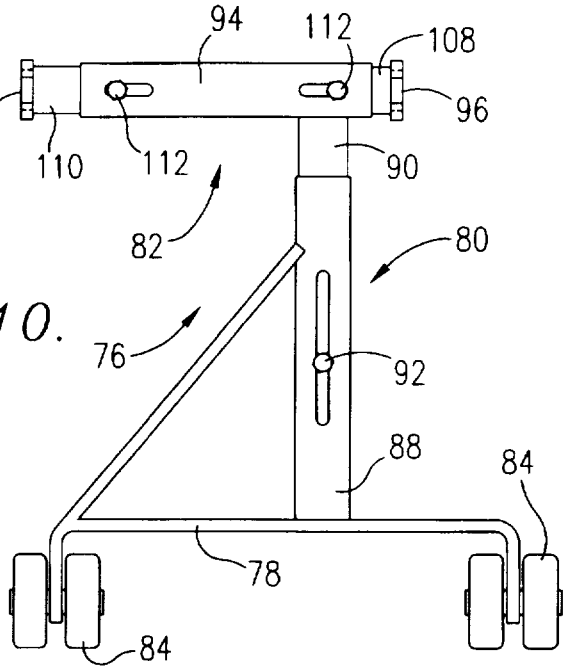
FIG. 10 is a view of the carriage assembly shown along line 10—10 of FIG. 6.
Figure 7:
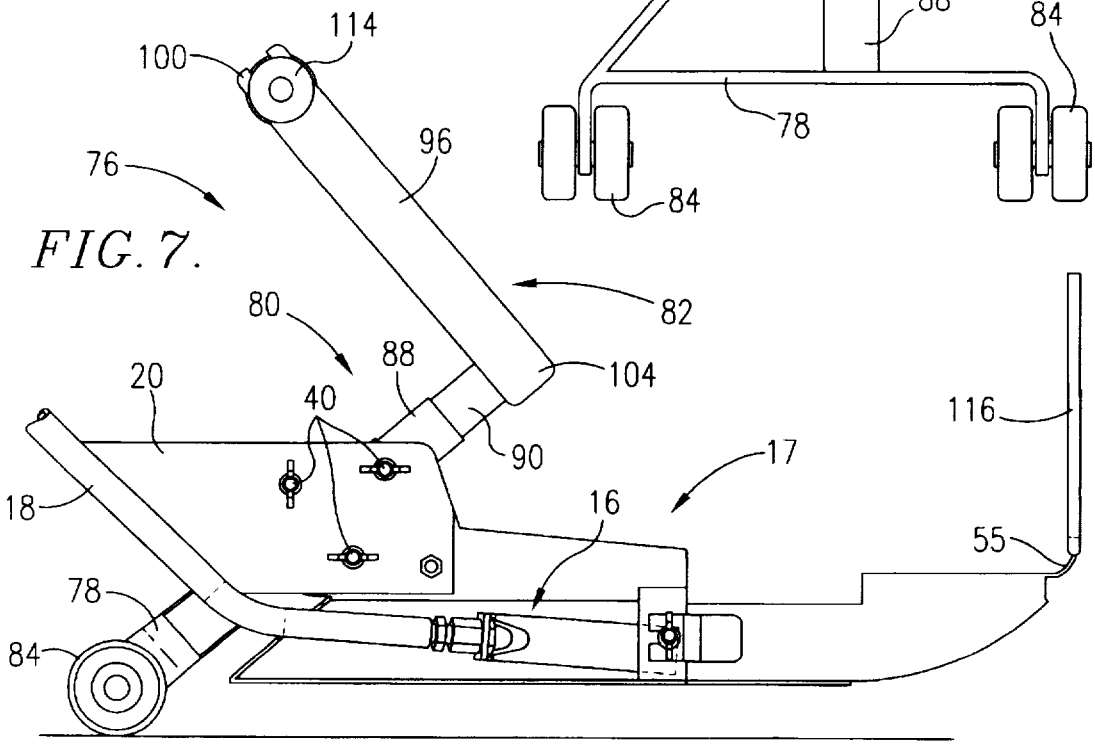
FIG. 7 is another side view of the carriage and torch head assemblies of FIG. 6.

Referring now to FIG. 10, a carriage assembly 76 coupled with the torch head assembly 17 constructed in accordance with the present invention is illustrated. The carriage assembly 76 is configured to carry a roll 77 of roofing membrane material, shown in FIG. 6.

The carriage assembly 76 broadly comprises a carriage bracket 78, in adjustable carriage arm assembly 80 and an adjustable support arm assembly 82. The carriage bracket 78 includes a plurality of wheels 84.

The carriage arm assembly 80 includes a flange 86 configured for attaching the carriage assembly 76 to the body 18 of torch head assembly 17. The flange 86 includes a plurality of holes defined there through which are adapted to receive connectors 40. The carriage arm assembly 80 also includes a main tubular member 88 and an extendable member 90 telescopically received within the main member 88. The extendable member 90 is configured for axial movement with respect to main tubular member 88 for adjusting the relative length of the carriage arm assembly 80. A fastener 92 is provided which is configured to fix the position of the extendable member 90 with respect to the main tubular member 88.

The support arm assembly 82 includes an open-ended support tube 94 which is coupled to the extendable member 90, and a pair of opposed support arms 96, 98. The support arms 96, 98 include distal ends 100, 102, and proximal ends 104, 106. U-shaped recesses are defined in each of the distal ends 100, 102.

The proximal ends include arm extension members 108, 110 which are telescopically received in the ends of the support tube 94. The extension members 108, 110 are configured for axial movement with respect to the support tube 94 to selectively adjust the distance between the support arms 96, 98. A pair of fasteners 112 are provided to fix the distance between the support arms 96, 98. It will be appreciated that by permitting adjustment of the length of the carriage arm assembly 80 and of the distance between support arms 96, 98, various sizes of roofing material rolls 77 may be carried by the carriage assembly 76.

A spindle 114 is received by the U-shaped recesses in the distal ends 101, 102 of the support arms 96, 98. The spindle 114 is configured to rotatably support the roll 77 between the support arms 96, 98. A roofing material guide 116 is coupled with upturned lip 55 to direct the roofing material as it is unrolled.

In use, the carriage assembly 76 is coupled with the web 20 of torch head assembly 17 by connectors 40. A roll 77 of roofing membrane material is mounted on the spindle 114, and positioned between the support arms 96, 98 so that spindle 114 is received in the U-shaped recesses of support arms 96, 98. An end of the roofing material is then fed through the guide 116.

Once the roll 77 has been loaded onto the carriage assembly 76, the torch head 16 is fired, with fuel gas being delivered through handle 12. As the torch is thus operated to create a flame of combustion products exiting head 16 and extending rearwardly through opening 54, the entire assembly 10 is pulled forwardly. This serves to unroll the roofing membrane material while uniformly heating the material after it passes through the guide 116. The material is thus laid on a work surface where it may be pressed by a roller or other similar device.

We claim:

1. A low profile torch head assembly adapted for coupling with an elongated handle to form a torch unit for use in fabricating roofs, said torch head assembly comprising:

a shoe element having upper and lower walls defining an elongated chamber presenting a rearward outlet opening; and an elongated torch head at least partially disposed within said shoe element between said upper and lower walls and having a forward end and an open, rearward, flame-exiting end oriented for delivering flame towards said element outlet opening.

said torch head being generally rectangular in cross-section and having a series of air inlets adjacent said forward end thereof.

2. The assembly of claim 1, said torch head having generally parallel top and bottom walls and generally upright sidewalls, said top and bottom walls being wider than said sidewalls.

3. The assembly of claim 1, the maximum height of said shoe element being up to about 4 inches.

4. The assembly of claim 2, said maximum height being up to about 3 inches.

5. The assembly of claim 1, said lower shoe element having a main panel section and an upturned section adjacent said rearward end, with said element outlet opening being located above said main panel section.

6. The assembly of claim 1, further including a carriage assembly coupled with said elongated torch head assembly and including a pair of support arms configured for supporting a roll of roofing material adjacent to said torch head.

7. The assembly of claim 6, said carriage assembly including means for adjusting the distance between said support arms.

* * * * *